US005980994A

United States Patent [19]

Honma et al.

[11] Patent Number: 5,980,994

[45] Date of Patent: Nov. 9, 1999

[54] ROTARY ATOMIZING ELECTROSTATIC COATING APPARATUS AND METHOD

[75] Inventors: Kengo Honma, Tokai; Isamu Yamasaki, Toyota, both of Japan

[73] Assignee: Toyota Jidosha Kabushiki Kaisha, Toyota, Japan

[21] Appl. No.: 08/834,416

[22] Filed: Apr. 16, 1997

[30] Foreign Application Priority Data

Apr. 17, 1996 [JP] Japan ..... 8-095549

[51] Int. Cl.[6] ..... B05D 1/04; B05D 1/40; B05B 5/04

[52] U.S. Cl. ..... 427/475; 427/480; 427/484; 118/621; 118/629; 239/290; 239/703; 239/704

[58] Field of Search ..... 427/475, 480, 427/484; 118/620, 621, 629; 239/290, 696, 703, 704

[56] References Cited

U.S. PATENT DOCUMENTS 3,561,677 2/1971 Norris et al. ..... 239/15
4,555,058 11/1985 Weinstein et al. ..... 239/223
4,767,056 8/1988 Demetrius et al. ..... 239/288

FOREIGN PATENT DOCUMENTS 3-101858 4/1991 Japan .
7-265746 10/1995 Japan .
2 283 927 5/1995 United Kingdom .

*Primary Examiner*—Frederick Parker
*Attorney, Agent, or Firm*—Pillsbury Madison & Sutro LLP

[57] ABSTRACT

A rotary atomizing electrostatic coating apparatus includes a plurality of shaping air nozzles for expelling shaping air having a pressure of about 80–250 kPa at an exit of each shaping air nozzle and having an amount of air to be expelled per nozzle of about 10–20 Nl min. Each shaping air nozzle has a diameter of about 0.6–1.5 mm. The number of shaping air nozzles is determined so that a summation of diameters of all shaping air nozzles is equal to between about ⅙–¼ times an entire circumferential length of a greatest outside diameter of the atomizing head.

11 Claims, 5 Drawing Sheets

ROTARY ATOMIZING ELECTROSTATIC COATING APPARATUS AND METHOD

This application is based on Japanese Patent Application HEI 8-95549 filed in Japan on Apr. 17, 1996, the content of which is incorporated into the present application by reference.

BACKGROUND OF THE INVENTION

1. Field of the Invention

The present invention relates to a rotary atomizing electrostatic coating apparatus for use in metallic paint coating.

2. Description of the Related Art

Japanese Patent Publication No. HEI 3-101858 discloses a rotary electrostatic coating apparatus using metallic paint. In the case where metallic paint containing aluminum or mica flakes is used, the speed at which the paint particles collide with an object to be coated is too low, resulting in a coated surface that is dark and without good brightness. To increase the collision speed shaping air is usually expelled at a high speed against the paint particles dispersed from an atomizing head to accelerate the paint particles in the direction toward the object to be coated. In this instance, the shaping air may be directed at an incline of about 30–40 degrees from a line parallel to an axis of rotation of the atomizing head to maintain good spreading despite using the high speed shaping air.

To obtain a high coating quality in metallic paint coating, the paint particles must collide with the surface of the object to be coated at a high speed. In a conventional coating, high pressure shaping air (for example, about 350–400 kPa) is expelled against the paint dispersed from the atomizing head so that the paint particles are accelerated toward the object to be coated. However, the shaping air expelled at a high pressure draws air around the shaping air flow to generate a secondary air flow accompanying the shaping air flow. As a result, when the shaping air flow reaches the object to be coated, the amount of air is generally increased to about 20–100 times more than the initial amount of the shaping air at the shaping air nozzles. Although the increased amount of air is necessary to carry paint particles to the object to be coated, the increased air also generates an air flow along the surface of the object to be coated, which prevents the paint particles from adhering smoothly to the surface of the object. This means that the use of high pressure air generates a considerably large amount of the air flow along the surface of the object so that the paint adhesion efficiency decreases, resulting in an increase in the consumption of the paint.

Further, the large amount of the air flow along the surface of the object whirls up paint particles which have not adhered to the object. As a result, the whirled-up paint particles adhere to the coating apparatus, the booth and the robot, and the adhering paint may drop onto the object to be coated to degrade or deteriorate the coating quality.

SUMMARY OF THE INVENTION

An object of the present invention is to provide a rotary atomizing electrostatic coating apparatus that can assure a collision speed of paint particles necessary for metallic paint coating and can suppress an increase in an amount of an air flow accompanying the shaping air flow to thereby maintain a high paint adhesion efficiency.

To achieve the above-described object in a rotary atomizing electrostatic coating apparatus according to the present invention, a plurality of shaping air nozzles are formed in an air cap for expelling shaping air at a predetermined pressure and at a predetermined flow amount. The predetermined pressure of the shaping air is set at about 80–250 kPa at an exit of each shaping air nozzle. The predetermined flow amount of the shaping air is set at about $10–20\times10^{-}Nm^3$ min.

Further, the exit diameter of each shaping air nozzle is selected to be within the range of about at 0.6–1.5 mm.

Furthermore, the number of the shaping air nozzles is determined so that the summation of the diameters of all of the shaping air nozzles is equal to one-sixth to one-fourth times an entire circumference of the portion of the atomizing head having the greatest outer diameter, that is, the front end of the atomizing head.

The predetermined pressure is controlled by a control valve (not shown) disposed between the shaping air nozzles and an air source (not shown) connected to the shaping air nozzles.

In the above-described apparatus, since the pressure of the shaping air at the exit of each shaping air nozzle is set at a low pressure (about 80–250 kPa), the amount of accompanying air generated around the shaping air is decreased. Further, since the amount of the shaping air expelled from each shaping air nozzle is set at about 10–20×10–3 $Nm^3$/min, the speed of the shaping air flow is prevented from being decreased. As a result, both an excellent metallic feeling of the coating and a high paint adhesion efficiency can be satisfied.

In the case where the diameter of each shaping air nozzle is set at about 0.6–1.5 mm, the amount and speed of the shaping air can be easily controlled. Further, in the case where the number of the shaping air nozzles is determined so as to satisfy that the summation of the diameters of all of the shaping air nozzles is equal to about one-sixth to one-fourth of the entire circumference of the atomizing head, the paint can be expelled in a uniform and stable manner.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

Figure 1:
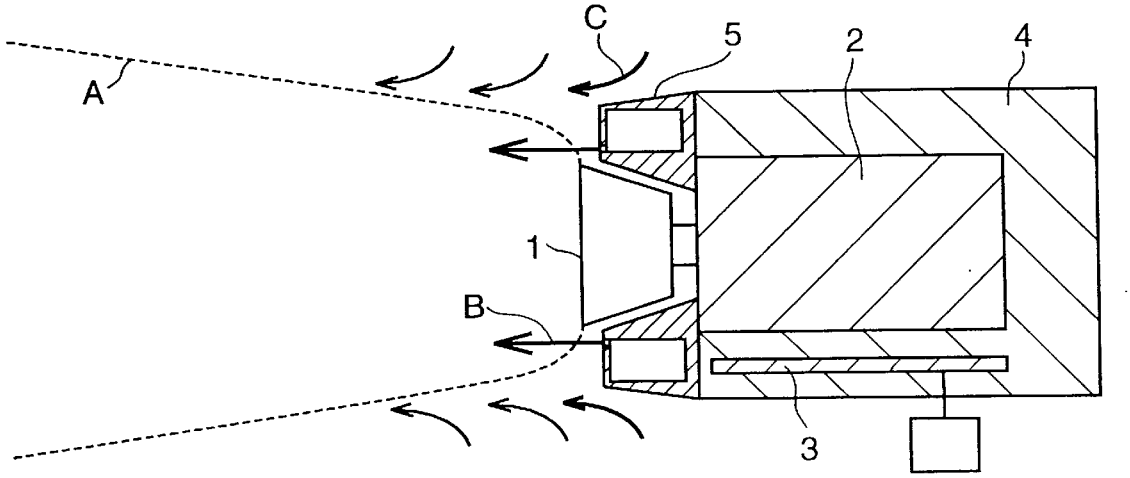
FIG. 1 is a schematic cross-sectional view of a rotary atomizing electrostatic coating apparatus according to one embodiment of the present invention.
Figure 2:
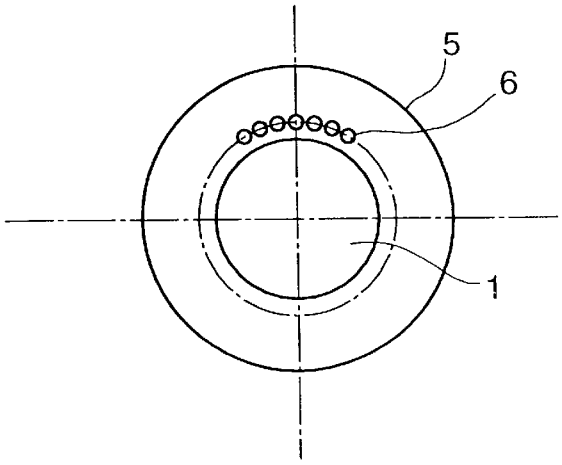
FIG. 2 is a front elevational view of the apparatus of FIG. 1.

FIGS. 1 and 2 illustrate a rotary atomizing electrostatic coating apparatus according to one embodiment of the present invention.

As illustrated in FIGS. 1 and 2, the rotary atomizing electrostatic coating apparatus includes an atomizing head 1 for atomizing paint. The atomizing head 1 has an axis of rotation and is rotatable about the axis of rotation and driven by an air motor 2. The atomizing head 1 is charged with a high voltage of electricity of about −60 to −90 kV. The air motor 2 is covered with a cover 4 made from synthetic resin. The apparatus further includes an air cap 5 coupled to a front end of the cover 4. In the air cap 5, a plurality of shaping air nozzles 6 are formed for accelerating paint particles in a direction toward an object to be coated. Each shaping air nozzle 6 has an axis inclined (or twisted) from a line parallel to the axis of rotation of the atomizing head 1 by about 30–40 degrees to spread a pattern of the shaping air flow. In FIG. 1, letter A illustrates a shaping air and paint pattern, letter B illustrates a shaping air expelled from the shaping air nozzles 6, and letter C illustrates an air flow accompanying the shaping air flow.

To obtain a high brightness in metallic paint coating, it is important to cause paint particles to collide with the object to be coated at a high speed so that aluminum or mica flakes contained in the paint become arranged parallel to the surface of the object to be coated.

Figure 3:
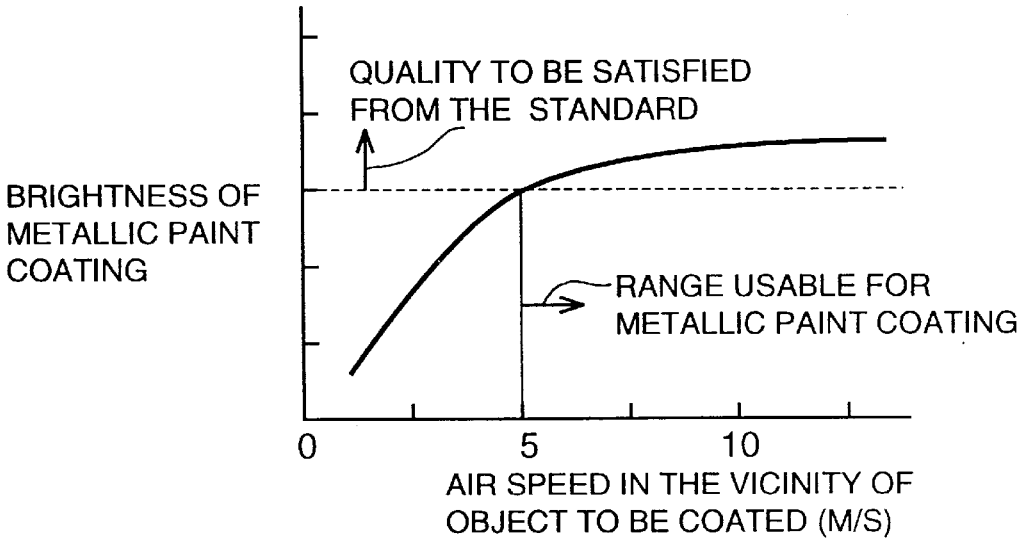
FIG. 3 is a graph illustrating a relationship between a speed of an air flow in the vicinity of an object to be coated and a brightness of metallic paint coating.

FIG. 3 illustrates a relationship, obtained in tests using a conventional coating apparatus, between a speed of an air flow in the vicinity of the object to be coated and a brightness of the metallic paint coating. As seen from FIG. 3, the speed of the shaping air flow in the vicinity of the surface of the object to be coated should be in the range of about 5 m/sec or higher to satisfy the required standard brightness quality. Another aspect of the present invention is to satisfy the speed requirement.

Figure 4:
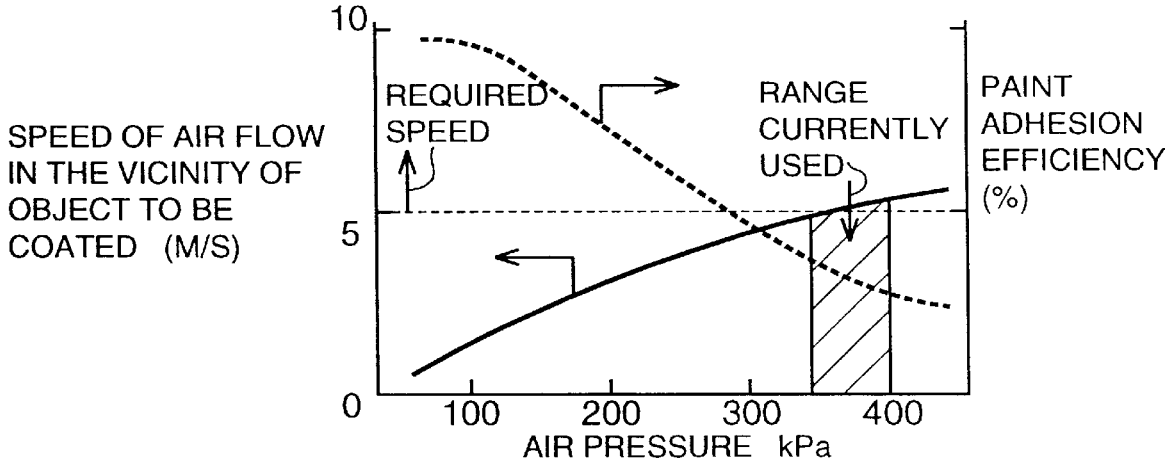
FIG. 4 is a graph illustrating a relationship between an air pressure and a speed of an air flow in the vicinity of the object to be coated and a paint adhesion efficiency.

FIG. 4 illustrates a relationship, obtained in tests using the conventional apparatus, between air pressure of the shaping air and air speed in the vicinity of the object to be coated and a paint adhesion efficiency. In the conventional coating, shaping air having a high pressure (about 350–400 kPa) was used to obtain the necessary speed (about 5 m/sec or higher).

Figure 5:
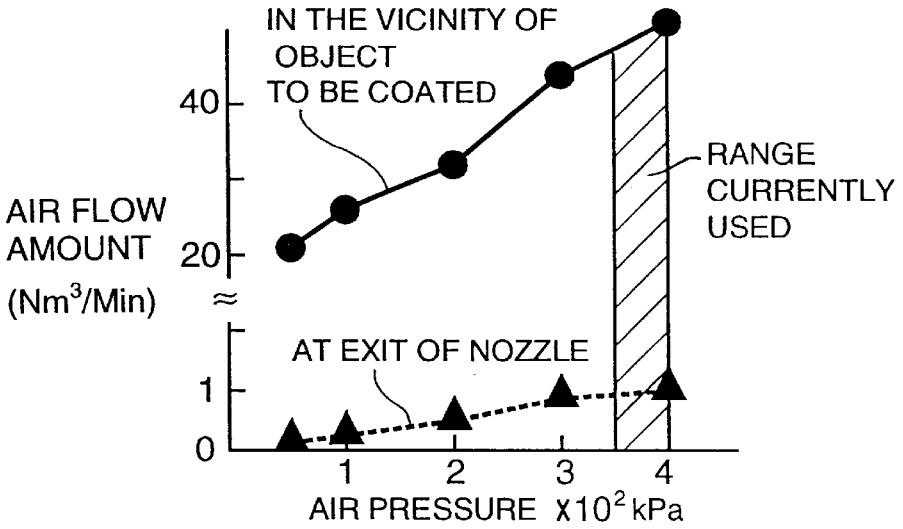
FIG. 5 is a graph illustrating a relationship between an air pressure and an air flow amount.

FIG. 5 illustrates a relationship, obtained in tests using the conventional apparatus, between an air pressure of the shaping air and air flow amounts at the exit of the shaping air nozzle and in the vicinity of the object to be coated. As seen from FIG. 5, the air flow amount in the vicinity of the object to be coated is much larger than the air flow amount at the shaping air nozzle. This means that the shaping air flow draws air around the shaping air flow to increase in amount while it flows toward the object to be coated. Further, it is seen that the larger the pressure, the larger the increase in the air flow amount. Therefore, in the case where the shaping air having the high pressure (about 350–400 kPa) is used (the hatched range in FIG. 5), the paint adhesion efficiency is decreased to a great extent as discussed above.

Therefore, in order to improve the paint adhesion efficiency, it is important to conduct the coating using shaping air having a lower pressure than the conventional art to thereby decrease the amount of the accompanying air, and further to maintain the air speed in the vicinity of the object to be coated to be about 5 m/sec or higher.

In an apparatus according to the preferred embodiment of the present invention, high pressure air is not used to maintain the necessary speed (about 5 m/sec or higher). Instead, in the present invention, the shaping air is used at a lower pressure and the amount of the air expelled from the shaping air nozzle is optimized (more than the amount in the conventional method) to maintain the necessary air speed (about 5 m/sec or higher).

Figure 6:
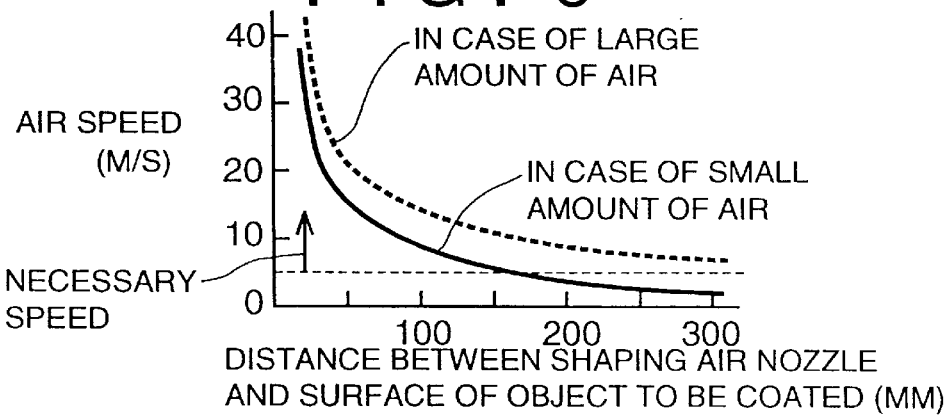
FIG. 6 is a graph illustrating a relationship between a distance of the shaping air nozzles and the object to be coated and an air speed.

As illustrated in FIG. 6, the speed of the air expelled from the shaping air nozzle decreases when the air approaches the object to be coated. In a case where the amount of air expelled from the nozzle is small (as in the conventional method), the kinetic energy of the air is small so that the drop in speed along the air flow is large. Therefore, to ensure a necessary speed in the vicinity of the object to be coated in this case, the air needs to be expelled at a high pressure (i.e., in the conventional method). In contrast, in a case where the amount of air expelled from the shaping air nozzle is large (as in the method according to the present invention), the kinetic energy of the air at the exit of the nozzle is large, so that the drop in speed along the air flow is small. As a result, despite the fact that the air is expelled at a low pressure, the necessary speed (about 5 m/sec or higher) is maintained in the vicinity of the object to be coated.

Figure 7:
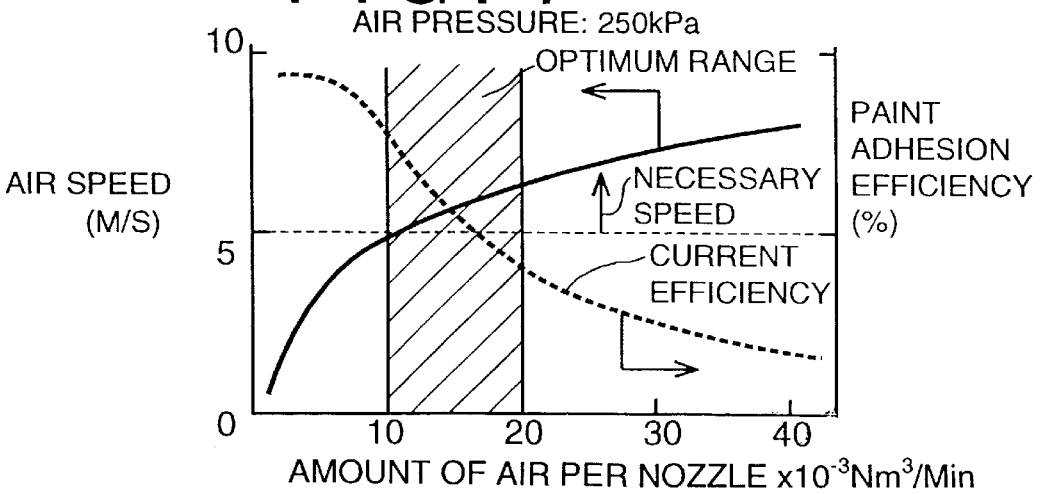
FIG. 7 is a graph illustrating a relationship between an amount of air expelled from each shaping air nozzle and an air speed in the vicinity of the object to be coated and a paint adhesion efficiency.

FIG. 7 illustrates results of tests to determine an optimum amount of air expelled at a low pressure. The low pressure was selected to be about 250 kPa at the exit of the shaping air nozzle in the tests. FIG. 7 illustrates a relationship obtained in the tests between the amount of air expelled per nozzle and the air speed in the vicinity of the object to be coated and the paint adhesion efficiency. Even when the air pressure was varied in the range of about 80–250 kPa, a relationship similar to that of FIG. 7 was obtained. As seen from FIG. 7, when the amount of expelled air is small, the speed necessary for metallic coating (5 n/sec or higher) cannot be ensured. Conversely, when the amount of expelled air is large, the paint adhesion efficiency decreases. Therefore, to ensure the necessary speed (about 5 m/sec or higher) and to obtain the high paint adhesion efficiency, an amount of air expelled per nozzle should be set at a range (optimum range) of about $10–20\times10^{-3}$ $Nm^3$/min ($10–20\times10^{-3}$ $Nm^3$/min).

Figure 9:
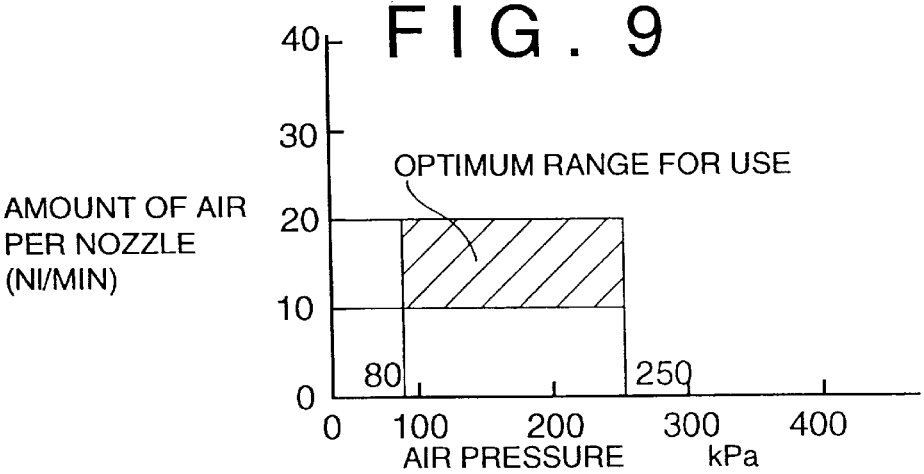
FIG. 9 is a graph illustrating a relationship between an amount of air expelled from each shaping air nozzle and a brightness of a metallic paint coating, and an optimum range thereof.

The reason for determining the range of the air pressure to be about 80–250 kPa above, is that if the pressure exceeds about 250 kPa, the accompanying air flow increases to approach the conventional state and about 250 kPa is a limit for distinguishing the present invention from the conventional method. If the pressure is lower than about 80 kPa, it is difficult to form a uniform paint flow pattern. As a result, the optimum range is a range shown in FIG. 9 by hatching.

Figure 8:
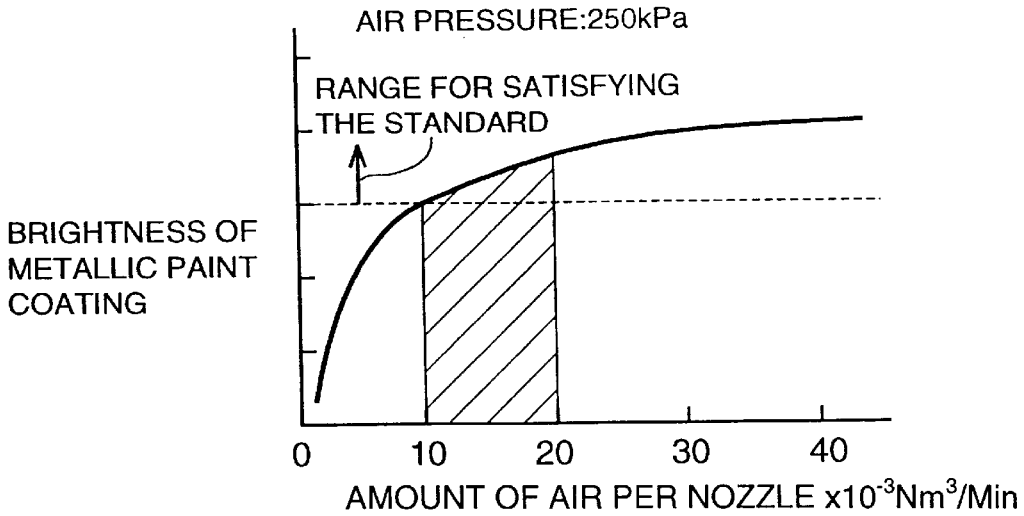
FIG. 8 is a graph illustrating a relationship between an amount of air expelled from each shaping air nozzle and a brightness of a metallic paint coating.
Figure 10:
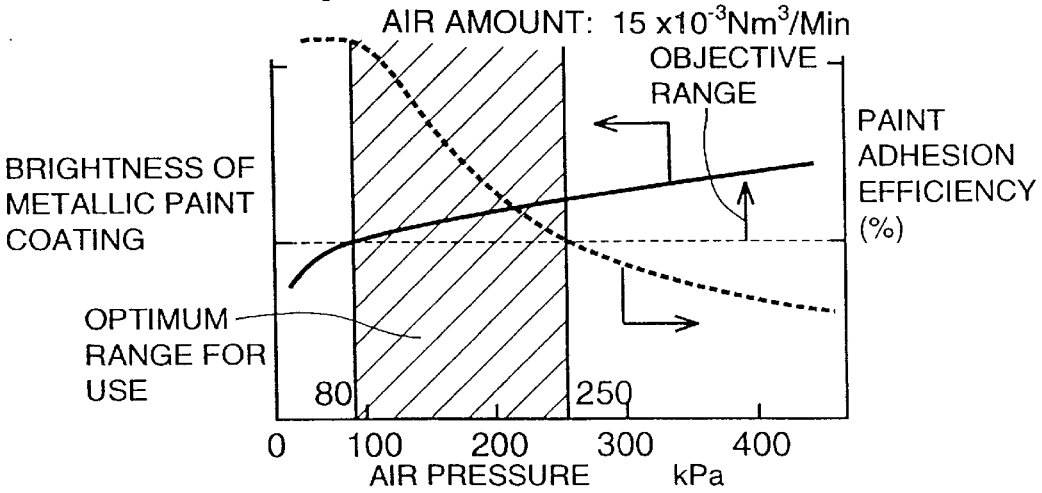
FIG. 10 is a graph illustrating a relationship between an air pressure and a brightness of a metallic paint coating.
Figure 11:
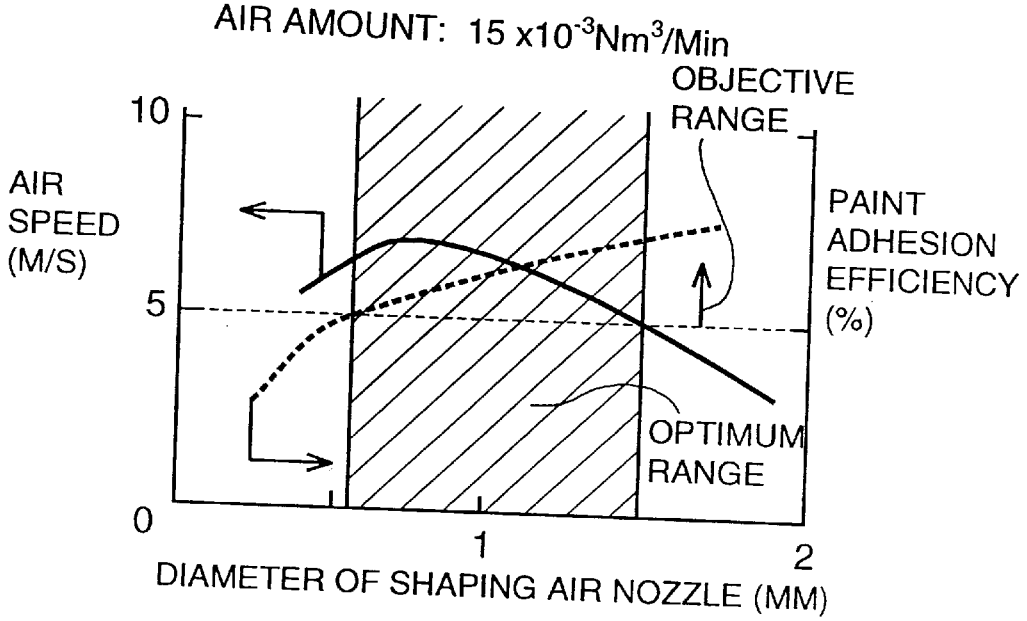
FIG. 11 is a graph illustrating a relationship between a diameter of each shaping air nozzle and a speed of an air flow in the vicinity of an object to be coated.

FIG. 8 illustrates a relationship, obtained in tests, between a brightness of the metallic paint coating and an amount of air expelled per nozzle. As seen from FIG. 8, a sufficient coating quality is ensured by selecting the amount of air expelled per nozzle to be in the range of about $10–20\times10^{-3}$ $Nm^3$/min. In the present invention, though the amount of the air expelled in increased for obtaining the necessary air speed and obtaining the brightness of the metallic paint coating, as illustrated in FIG. 10, use of air having a low pressure (about 80–250 kPa) enables a decrease in the amount of accompanying air flow drawn by the shaping air flow so that the paint adhesion efficiency is improved. This is one of the important points of the present invention.

In order that a great amount of air (about $10–20\times10^{-3}$ $Nm^3$/min) can be expelled even at the lower pressure (about 80–250 kPa), the diameter of the shaping air nozzle is determined to be greater than that of the nozzle of the conventional apparatus. However, if too large, the controlled pressure will be too low to be controllable, and it will be difficult to ensure the speed of about 5 m/sec or higher. If too small, the amount of the shaping air will be too small, so that the paint adhesion efficiency will decrease. Therefore, the nozzle diameter should be selected to be in the range of about 0.6–1.5 mm (more preferably, at about 0.8 mm).

Figure 12:
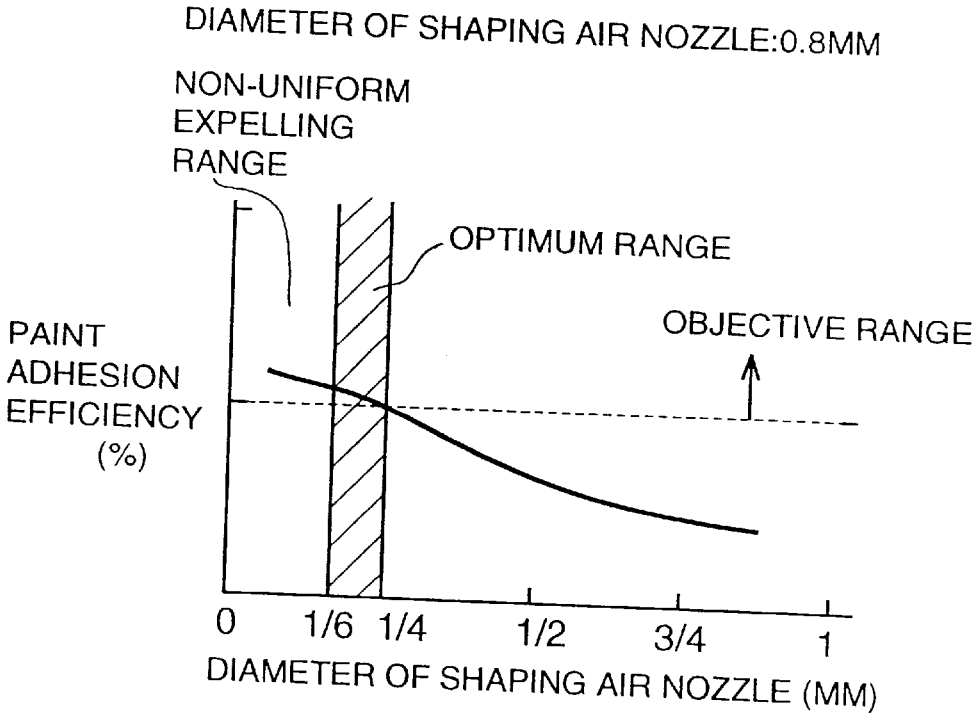
FIG. 12 is a graph illustrating a relationship between a diameter of each shaping air nozzle and a paint adhesion efficiency.

Further, to obtain a uniform paint flow pattern in the form of a membrane and a good paint adhesion efficiency, the number of the shaping air nozzles formed in the shaping air cap and arranged along the circumference of the atomizing head is determined so that a summation of the diameters (diametrical lengths) of all of the nozzles is in the range of about ⅙–¼ times an entire circumference of the portion of the atomizing head having the greatest outer diameter, that is, the front end of the atomizing This was proved in tests and the test results are shown in FIG. 12. An additional reason for the limit of about ¼ is that exceeding it causes excessive air flow accompanying the shaping air and a decrease in the paint adhesion efficiency.

A coating method is conducted using the above-described rotary atomizing electrostatic coating apparatus that includes the housing, the rotatable atomizing head having the axis of rotation, the air motor housed within the housing for driving the atomizing head, and the shaping air cap coupled to the front end of the housing and having a plurality of shaping air nozzles formed therein. The coating method includes the steps of setting the shaping air pressure to be at about 80–250 kPa at the exit of each shaping air nozzle and the amount of shaping air per nozzle to be at about $10–20\times10^{-3}$ $Nm^3$/min, and conducting metallic paint coating.

In the coating conducted using the apparatus according to the embodiment of the present invention, since the pressure of shaping air is low, the paint adhesion efficiency is improved and consumption of paint is decreased.

Further, since the amount of air flow in the vicinity of the object to be coated is relatively small, the amount of whirled-up paint particles is decreased. As a result, the amount of the paint particles dropping onto the coating apparatus and the coating robot is decreased which decreases generation of coating defects and maintenance of the apparatus and robot.

According to the present invention, the following advantages are obtained:

First, since the pressure of the shaping air is set at about 80–250 kPa at the exit of the shaping air nozzle, the amount of air flow accompanying the shaping air flow is decreased. Further, since the amount of air expelled per shaping air nozzle is set at about $10–20\times10^{-3}$ $Nm^3$/min, the air speed is maintained high. As a result, both a metallic coating having a good appearance and a high paint adhesion efficiency are satisfied.

Second, in the case where the diameter of each shaping air nozzle is set at about 0.6–1.5 mm, the shaping air is controllable. Further, in the case where the summation of the diameters of all of the shaping air nozzles is set to between about ⅙–¼ times of the entire circumferential length of the atomizing head, a uniform paint flow pattern his obtained.

Although the present invention has been described with reference to specific exemplary embodiments, it will be appreciated by those skilled in the art that various modifications and alterations can be made to the particular embodiments shown, without materially departing from the novel teachings and advantages of the present invention. Accordingly, it is to be understood that all such modifications and alterations are included within the spirit and scope of the present invention as defined by the following claims.

What is claimed is:

1. A rotary electrostatic atomizing coating apparatus comprising:

a housing;

an atomizing head for electrostatically charging paint particles disposed on a front side of said housing, said atomizing head having an axis of rotation and being rotatable about said axis of rotation;

an air motor disposed within said housing for driving said atomizing head; and an air cap having nozzles, said air cap disposed on the front side of said housing, said nozzles consisting of a plurality of shaping air nozzles formed in said air cap for expelling shaping air at a predetermined pressure and at a predetermined amount of air, said plurality of shaping air nozzles being arranged on a single circle having a circle center thereof on said axis of rotation of said atomizing head, said plurality of shaping air nozzles each having an exit;

wherein said predetermined pressure of said shaping air at said exit of each of said plurality of shaping air nozzles is set at a value within the range of about 80–250 kPa, thereby generating a stream of surrounding air that accompanies said shaping air, and said predetermined amount of air expelled per shaping air nozzle is set at about $10–20\times10^{-3}$ $Nm^3$/min, said predetermined amount of air thereby substantially maintaining its speed to an object to be coated.

2. An apparatus according to claim 1, wherein each of said plurality of shaping air nozzles has an axis inclined from a line parallel to said axis of rotation of said atomizing head.

3. An apparatus according to claim 1, wherein said exit of each of said shaping air nozzles has a diameter selectable within the range of about 0.6–1.5 mm.

4. An apparatus according to claim 3, wherein said diameter is about 0.8 mm.

5. A rotary atomizing coating apparatus according to claim 1, wherein said air cap is constructed and arranged such that said predetermined pressure has a value and said predetermined amount of air at said exit of each of said shaping air nozzles has a value such that said shaping air has a speed equal to or higher than about 5 m/sec at an object to be coated.

6. A rotary atomizing coating apparatus according to claim 1, wherein a summation of diameters of a total number of said plurality of shaping air nozzles is equal to about one-sixth to one-fourth times a length of an entire circumference of a greatest outside diameter of said atomizing head.

7. A rotary atomizing coating apparatus according to claim 1, wherein substantially all shaping air nozzles formed in said air cap are arranged on said circle.

8. An electrostatic coating method using an apparatus comprising:

a housing;

an atomizing head for electrostatically charging paint particles disposed on a front side of said housing, said atomizing head having an axis of rotation and being rotatable about said axis of rotation;

an air motor, disposed within said housing, for driving said atomizing head; and an air cap disposed on the front side of said housing, said air cap having a plurality of shaping air nozzles formed therein for expelling shaping air at a predetermined pressure and at a predetermined amount, said plurality of shaping air nozzles being arranged on a circle having a circle center thereof on said axis of rotation of said atomizing head, said plurality of shaping air nozzles each having an exit;

said method comprising the steps of:

setting said predetermined pressure of said shaping air at said exit of each of said plurality of shaping air nozzles to a value within the range of about 80–250 kPa, thereby generating a stream of surrounding air that accompanies said shaping air;

setting said predetermined amount of air expelled per shaping air nozzle to a value within the range of about $10–20\times10^{-3}$ $Nm^3$/min, said predetermined amount of air thereby substantially maintaining its speed to an object to be coated; and conducting coating of said object.

9. A coating method according to claim 8, wherein said predetermined pressure and said predetermined amount of air at said exit of each of said shaping air nozzles are determined so that said shaping air has a speed equal to or higher than about 5 m/sec at an object to be coated.

10. A coating method according to claim 8, wherein a total number of said plurality of shaping air nozzles is determined so that a summation of diameters of all of said shaping air nozzles is equal to about one-sixth to one-fourth times an entire circumferential length of a portion of said atomizing head having a greatest outside diameter.

11. A coating method according to claim 8, wherein substantially all shaping air nozzles formed in said air cap are arranged on said circle.

* * * * *